United States Patent [19]

Kennedy et al.

[11] 4,373,294

[45] Feb. 15, 1983

[54] DOOR FOR A MINE STOPPING HAVING KNIFE-EDGE HINGES

[76] Inventors: John M. Kennedy; William R. Kennedy, both of P.O. Box 38, Taylorville, Ill. 62568

[21] Appl. No.: 198,203

[22] Filed: Oct. 17, 1980

[51] Int. Cl.[3] ..... E05D 7/88

[52] U.S. Cl. ..... 49/388; 49/402; 292/228

[58] Field of Search ..... 49/388, 402; 292/228

[56] References Cited

U.S. PATENT DOCUMENTS

| | | | |
|---|---|---|---|
| 1,701,6[illegible] | 2/1929 | Paine | 49/388 X |
| 2,253,39[illegible] | 8/1941 | Reifenberg | 49/388 |
| 4,082,3[illegible] | 4/1978 | Kennedy et al. | 292/228 |
| 4,118,894 | 10/1978 | Kennedy et al. | 49/402 |

FOREIGN PATENT DOCUMENTS

| | | | |
|---|---|---|---|
| 2059803 | 6/1971 | Fed. Rep. of Germany | 49/388 |
| 2118878 | 1/1941 | Switzerland | 49/388 |

*Primary Examiner*—Kenneth Downey

*Attorney, Agent, or Firm*—Senniger, Powers, Leavitt and Roedel

[57] ABSTRACT

A door for closing a man-door opening in a mine stopping, the door having a pair of knife-edge hinges one at each of the two upper corners of the door for mounting the door to swing about a horizontal axis adjacent the top edge of the man-door opening between open and closed positions. Each hinge comprises a horizontally extending pivot pin and a vertically extending lug comprising a relatively thin metal plate member having a hole therein adapted to receive the pivot pin, whereby the area of engagement between the pivot pin and the lug is relatively small so that corrosion on the hinge at said area of engagement does not inhibit opening of the door.

3 Claims, 4 Drawing Figures

DOOR FOR A MINE STOPPING HAVING KNIFE-EDGE HINGES

BACKGROUND OF THE INVENTION

This invention relates to a door for a mine stopping, and more particularly to such a door hingedly mounted so as to swing about a horizontal axis at the top of a man-door opening in a mine stopping.

So-called "stoppings" are widely used in mines to stop off flow of air in passages in the mines, a stopping generally being a masonary (e.g., concrete block) or metal wall installed at the entrance of a passage to block flow of air therethrough. It is often desired that such stoppings be provided with a door, which is referred to as a "man door", for occasional access to the blocked-off passage, the door having steel hinges for mounting the door to swing between open and closed positions. Prior "man doors" have conventional hinges each comprising a hinge pin and hinge leaves; and a problem with the prior "man doors" has been that under damp conditions encountered in a mine corrosion may occur on the hinges at the area of engagement between the hinge pin and hinge leaves, and the corrosion, if sufficiently encrusted on the hinges, may prevent relative motion between the hinge leaves and pins, and thus inhibit opening of the door.

The invention is in the same field as and may be regarded as representing an improvement upon the doors for a mine stopping disclosed in U.S. Pat. Nos. 4,082,331 and 4,118,894.

SUMMARY OF THE INVENTION

Among the several objects of this invention may be noted the provision of a "man door" for a mine stopping which can be opened even if the door hinges become heavily encrusted with corrosion; the provision of such a door with improved hinges; and the provision of such a door which is of relatively simple and economical construction.

In general, the door of this invention has a pair of knife-edge hinges one at each of the two upper corners of the door for mounting the door to swing about a horizontal axis adjacent the top edge of the man-door opening between open and closed positions. Each knife-edge hinge comprises a horizontally extending pivot pin and a vertically extending lug comprising a relatively thin metal plate member having a hole therein adapted to receive the pivot pin, whereby the area of engagement between the pivot pin and the lug is relatively small so that corrosion on the hinge at said area of engagement does not "freeze" the door shut.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
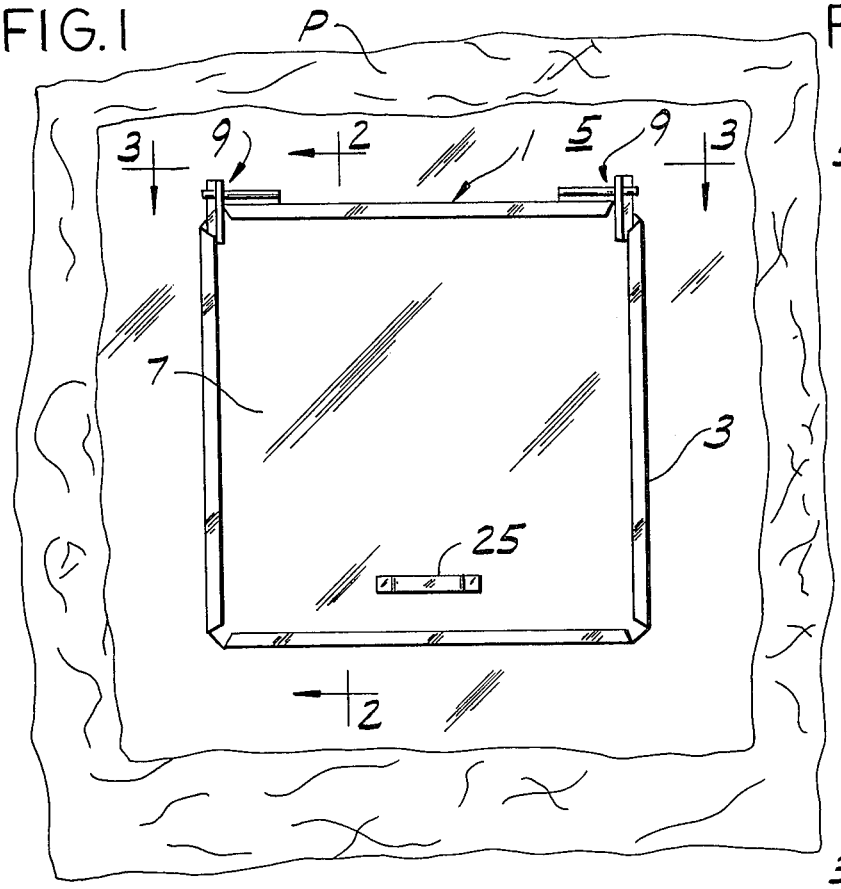
FIG. 1 is a front elevation of a mine stopping having a door of this invention installed in a man-door opening in the stopping.
Figure 2:
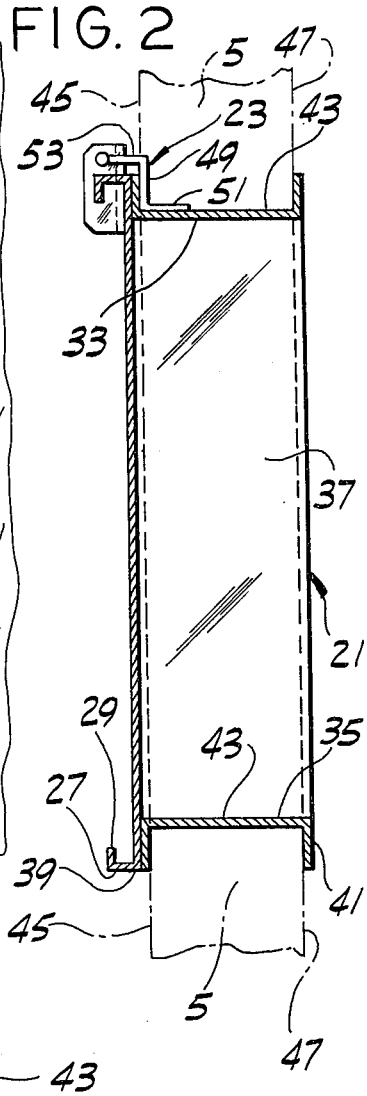
FIG. 2 is a vertical section on line 2—2 of FIG. 1 showing the door hingedly connected to a door frame in the man-door opening.
Figure 4:
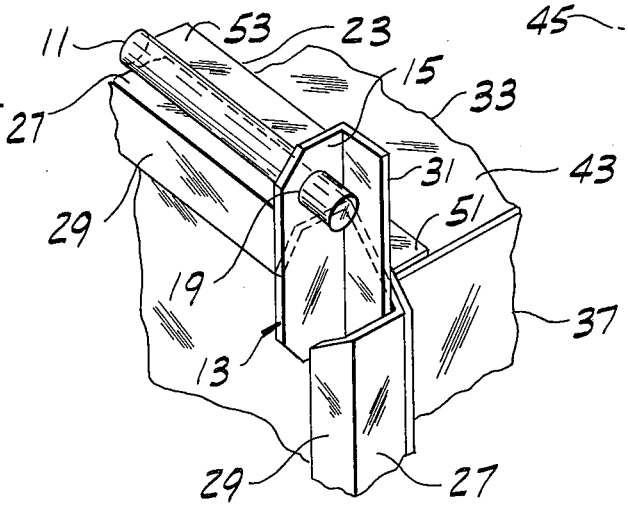
FIG. 4 is an enlarged perspective of the hinge at the upper right-hand corner of the door and the door frame.
Figure 3:
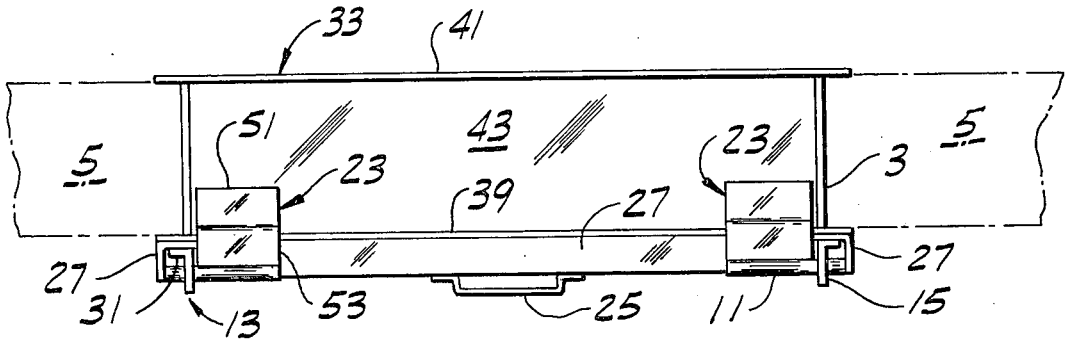
FIG. 3 is a horizontal section on line 3—3 of FIG. 1 with portions of the mine stopping broken away.

Referring to the drawings, there is generally indicated at 1 a door of this invention as installed in a man-door opening generally indicated at 3 in a masonry mine stopping 5, e.g., a concrete block mine stopping, the latter typically being built up at the entrance of a no longer used passage P in a mine to block flow of air through the passage. The door 1 comprises a generally rectangular metal plate 7 and has a pair of knife-edge hinges 9 one at each of the two upper corners of the door for mounting the door to swing about a horizontal axis adjacent the top edge of the man-door opening between open and closed positions. Each knife-edge hinge 9 comprises a horizontally extending pivot pin 11 and a vertically extending lug 13 comprising a relatively thin metal plate member 15 (e.g., 16 gauge steel) having a hole 19 therein adapted to receive the pivot pin 11, whereby the area of engagement between the pivot pin and the plate 15 is relatively small so that corrosion on the hinge at said area of engagement does not prevent opening of the door. A door frame 21 is mounted in the opening 3 in the stopping, and means 23 is provided for mounting the pivot pins 11 on the doorframe at the top of the man-door opening.

In particular, the door 1 has a handle 25 and flanges 27 at the edges of the door extending outwardly from the outer face of the door, each flange extending laterally along the respective edge of the door but stopping short of the corners of the door and having an inturned lip 29. The door is engageable at the edge margins of its inner face with the door frame 21 to provide a seal when closed.

The lug 13 is an angle-section member, one leg of the angle constituting the metal plate member 15, the other leg 31 being welded to the metal plate 7 of the door at an upper corner thereof. The lug 13 extends vertically between the flanges 27 at the top and the respective side of the door, the hole 19 in the lug being above the flange 27 at the top of the door.

The door frame 21 is generally square, measuring about thirty-two inches wide and thirty-two inches high inside dimensions, for example, comprising top and bottom channel members 33 and 35, respectively, and two opposed side channel members each designated 37. Each channel member comprises first and second flanges 39, 41 and a web 43 therebetween, the web of each channel member being adjacent an edge surface in the stopping at the man-door opening 3, the first flange extending alongside the forward face 45 (i.e., the face toward the door) of the stopping and the second flange extending alongside the rear face 47 of the stopping. The door at its inner face is engageable with the outer faces of the first flanges 39 of the channel members of the door frame. As will be understood, the stopping will typically be built up as a wall of concrete blocks from the floor of the passage P to the level of the bottom of the opening, the frame 21 mounted in position on the blocks and the remainder of the wall 5 built up around the frame.

The mounting means 23 comprises a pair of brackets, one for each pivot pin 11. Each bracket is located at an end of the top doorframe channel member 33 and is of Z-section, having a generally vertical web 49 welded to the inner face of the first flange 39 of the top channel member 33, a generally horizontal lower flange 51 extending in the direction away from the door welded to the web 43 of the top channel member, and a generally horizontal upper flange 53 above the top channel member extending to an end spaced forward of the outer face of the first flange 39 of the top channel member. Each pivot pin 11 is welded to the forward end of the upper flange 53 of the respective bracket and extends laterally of the respective bracket beyond the side of the man-door opening 3.

While the door frame 21 is shown to comprise channel members having flanges 39 closely adjacent the forward face 45 of the stopping 5 and the door 1 is shown to be generally vertical when in closed position, the door frame may be of the type disclosed in U.S. Pat. No. 4,082,331 comprising bottom and side channel members having flanges spaced from the forward face of the stopping for holding the door inclined when in closed position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door for closing a man-door opening in a mine stopping, said door being of metal and having a pair of knife-edge hinges, one at each of the two upper corners of the door for mounting the door to swing about a horizontal axis adjacent the top edge of the man-door opening between open and closed positions, each knife-edge hinge comprising a horizontally extending pivot pin and a vertically extending lug comprising a relatively thin metal plate member having a hole therein adapted to receive the pivot pin, whereby the area of engagement between the pivot pin and the lug is relatively small so that corrosion on the hinge at said area of engagement does not prevent opening of the door;

means for mounting said pivot pins at the top of the man-door opening;

said mounting means comprising a pair of brackets, each bracket having a generally vertical web, a generally horizontal lower flange extending away from the door, and a generally horizontal upper flange extending over the door, each pivot pin being welded to the upper flange of the respective bracket;

and a door frame being mounted in the man-door opening;

said door frame having a top, bottom, and two side channel members each having first and second flanges and a web therebetween, the web of each channel member being adjacent an edge surface of the stopping at the opening therein, the first flange of each channel member extending alongside the face of the stopping toward the door, and the second flange of each channel member extending alongside the face of the stopping away from the door.

2. A door as set forth in claim 1 wherein the web of each bracket is welded to the inner face of the first flange of the top channel member, the lower flange of each bracket being welded to the web of the top channel member.

3. A closure for a man-door opening in a mine stopping comprising a door frame for being mounted in the man-door opening, said frame having a top, bottom, and two side channel members each having first and second flanges and a web therebetween, the web of each channel member being adjacent an edge surface of the stopping at the opening therein, the first flange of each channel member extending alongside that face of the stopping toward the door, and the second flange of each channel member extending alongside that face of the stopping away from the door, a door comprising a metal plate pivoted on the frame at the two upper corners of the door and the frame by means of knife-edge hinges, each knife-edge hinge comprising a horizontally extending pivot pin at the respective upper corner of the door and a vertically extending lug at the respective upper corner of the frame, each lug comprising a relatively thin metal plate member having a hole therein receiving the respective pivot pin, whereby the area of engagement between the pivot pin and the lug is relatively small so that corrosion on the hinge at said area of engagement does not prevent opening of the door, and means for mounting each pin at the top of the door frame, each mounting means comprising a bracket mounted on the top channel member having a portion extending beyond said top channel member above the upper edge of the door, the pivot pins being welded to said extending bracket portions and extending laterally outwardly from said portions through the holes in said relatively thin metal plate members.

* * * * *